United States Patent [19]

Hebert

[11] 4,432,339

[45] Feb. 21, 1984

[54] SOLID FUEL BURNING HEATING SYSTEM

[76] Inventor: Carlton A. Hebert, R.F.D. #1, Box 430 (Starks), Anson, Me. 04911

[21] Appl. No.: 460,174

[22] Filed: Jan. 24, 1983

Related U.S. Application Data

[63] Continuation-in-part of Ser. No. 157,074, Jun. 6, 1980, abandoned.

[51] Int. Cl.[3] ..... F24B 9/00

[52] U.S. Cl. ..... 126/368; 126/367; 237/59; 122/15

[58] Field of Search ..... 126/5, 54, 53, 20, 34, 126/35, 53, 83, 132, 101, 366, 367, 368; 431/344, 347; 122/13 A, 15, 29, 50, 155 A, 33; 237/56, 59, 62, 66

[56] References Cited

U.S. PATENT DOCUMENTS

| | | | |
|---|---|---|---|
| 302,305 | 7/1884 | Wittbold | 126/367 |
| 365,971 | 7/1887 | Coyle . | |
| 367,209 | 7/1887 | Just et al. . | |
| 523,477 | 7/1894 | Laird . | |
| 1,119,195 | 12/1914 | Schuck | 126/368 |
| 1,599,323 | 9/1926 | Frank . | |
| 1,688,092 | 10/1928 | Smith | 126/35 |
| 1,710,665 | 4/1929 | Mertzanoff . | |
| 2,014,658 | 9/1935 | Masonick | 122/158 |
| 2,048,676 | 7/1936 | Baruch et al. | 122/155 |
| 2,238,362 | 4/1941 | Goehler | 237/63 |
| 2,396,252 | 3/1946 | Cross | 122/158 |
| 2,406,673 | 8/1946 | Drummond | 122/158 |
| 2,468,694 | 4/1949 | Torr | 126/344 |
| 2,592,980 | 4/1952 | Van Wert | 122/33 |
| 2,594,063 | 4/1952 | Norman | 237/67 |
| 3,308,805 | 3/1967 | Stoeckli | 126/113 |
| 4,088,113 | 5/1978 | McIntire et al. | 126/132 |

FOREIGN PATENT DOCUMENTS

| | | | |
|---|---|---|---|
| 53190 | 9/1910 | Switzerland | 126/368 |
| 189093 | 10/1936 | Switzerland | 126/368 |

*Primary Examiner*—Samuel Scott
*Assistant Examiner*—Randall L. Green
*Attorney, Agent, or Firm*—W. G. Fasse; D. H. Kane, Jr.

[57] ABSTRACT

A wood burning heating system comprises a large hot water storage tank and a furnace or boiler with a water jacket and a vaulted ceiling over a firebox with a refractory bottom and a refractory lining partially up the side walls of the firebox. The volume of the tank is about ten to twenty times larger than the volume of the water jacket, whereby the large hot water volume acts as a heat storage and as a buffer or heat output equalizer counteracting any intermittent heat input inherent in a solid fuel system especially a wood burning system. The firebox is elongated and the door is so arranged that wood pieces of random and substantial size may be charged into the firebox so that the wood is burning while it is in a horizontal position. The large hot water storage tank may receive additional heat input, for example from an electrical heater operated by a wind driven generator. If desired, the furnace may be installed inside the large hot water storage tank. The furnace or boiler with the tanks and interconnected pipes form a connected container system having a common water level and vented to the atmosphere above said common water level whereby the system works at atmospheric pressure and the boiler cannot develop any steam pressure.

20 Claims, 9 Drawing Figures

FIG. 3
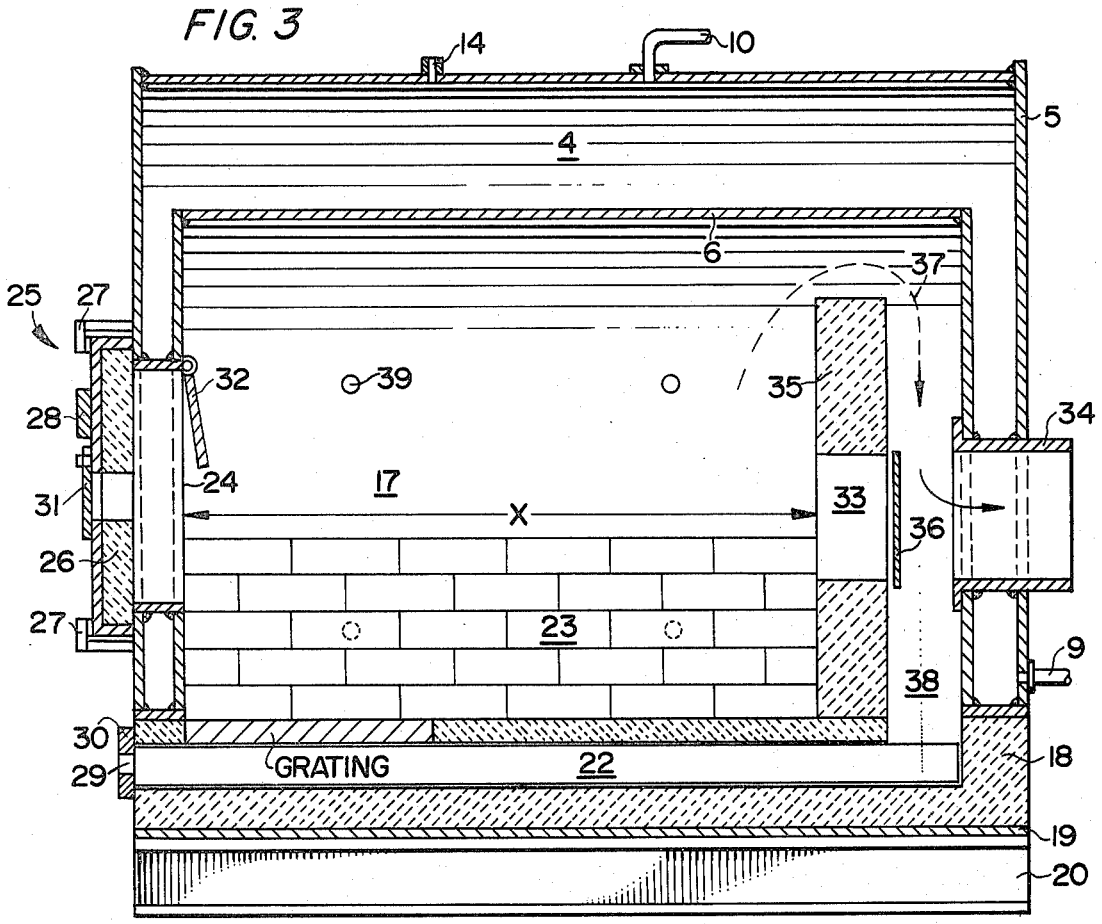
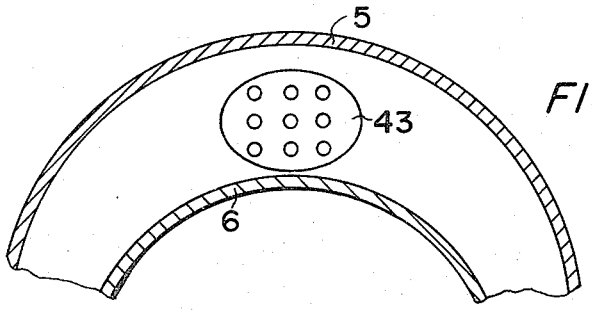
FIG. 4

SOLID FUEL BURNING HEATING SYSTEM

CROSS-REFERENCE TO RELATED APPLICATION

This application is a Continuation-In-Part patent application of my abandoned U.S. Pat. application Ser. No. 157,074, filed on June 6, 1980, entitled: "WOOD BURNING HEATING SYSTEM".

BACKGROUND OF THE INVENTION

The invention relates to a wood burning heating system for homes and commercial buildings. The system also supplies hot water for domestic and other purposes.

Many different structures for heating systems, boilers, furnaces, and fireplaces are known in the art for using all sorts of suitable fuels including coal, coke, wood, and similar fuels to avoid the use of fuel oil.

Oil is the most convenient fuel as far as combustion control, relatively clean burning, and efficiency are concerned. However, recent oil price rises have caused extensive efforts, including substantial research, for the return to using historically older fuels such as wood and coal, especially for home heating purposes. Gas produced by wood coking results in a fuel, the combustion of which is well controllable. However, the wood gas production is at present too involved for individual production for home heating purposes.

U.S. Pat. No. 4,088,113 (McIntire et al) discloses a wood burning, automatic swimming pool heater. The door of the combustion chamber is removable for using the heater as a fireplace. A set of heat exchanger pipes is located in the combustion chamber and apparently connected to a swimming pool. This type of system is not suitable for home heating because the water temperature in a swimming pool is too low for heating purposes.

U.S. Pat. No. 2,406,673 (Drummond) discloses a coal burning furnace. The coal is charged through a top loading door into a hopper reservoir above the combustion chamber whereby the coal is to slide gradually down by gravity into the combustion chamber. A secondary combustion chamber above the main combustion chamber contributes to a more efficient combustion. The system is pressurized and uses a small water reservoir as an integral part of the furnace.

U.S. Pat. No. 1,710,665 (Mertzanoff) discloses a coal fueled water heater wherein the combustion chamber is substantially surrounded by a first water chamber which communicates by gravity flow with a further water chamber above the combustion chamber. The total water volume is insufficient to constitute a reservoir for heat storage.

U.S. Pat. No. 2,396,252 (Cross) discloses a self-stoking coal fired water heater equipped with a water jacket surrounding the combustion chamber. Again, the water jacket does not provide any heat storing capacity. Similar considerations also apply to U.S. Pat. No. 2,014,658 (Masonick).

The prior art apparently has not recognized the need for a compromise that must be made because a wood or coal fire, once started, cannot be controlled to an extent similar to that of an oil or gas flame. Such fine controls as are available for controlling or regulating an electric heater are also not available for controlling a wood or coal fire. The induced and/or forced draft controls that have been used heretofore for controlling wood or coal fires are insufficient to achieve a relatively convenient heating system. A wood fueled heating system could be considered relatively convenient if it meets the following requirements: reloading of wood into the firebox should be necessary only about once a day, it should be safe against overheating, it should be substantially independent of other fuels such as electricity for control purposes and the dryness and type of wood used should not be too critical. Further, prior art systems aim at simplicity, yet there is room for improvement for achieving simplicity and with it affordability.

OBJECTS OF THE INVENTION

In view of the above it is the aim of the invention to achieve the following objects singly or in combination:

to construct a wood burning heating system which satisfies the above requirements and is compatible with the use of other heat sources such as active or passive solar collectors, and/or auxiliary heaters such as electrical heaters, for example, powered by wind or water generators;

to assure a supply of domestic hot water even if the electrical power should be interrupted;

to operate a wood fueled heating system at atmospheric pressure to avoid overheating;

to construct a wood burning firebox so that wood pieces of substantial and even irregular size may be placed into the firebox lengthwise and horizontally so that even unsplit wood may be efficiently burned;

to use gravity flow between a hot water reservoir and the radiators of the heating system;

to use the heat stored in a firebrick lining of the firebox as an aid for an efficient wood combustion and also as a heat storing component;

to minimize the hazards and labor involved in a conventional wood burning heating system;

to use a large hot water storage tank in combination with a wood burning furnace, whereby the large hot water storage tank may be arranged to receive heat inputs from different heat sources;

to avoid the difficulties and structural complications that are involved in controlling the wood combustion beyond a point which would make the system impractical for the average household; and to effectively combust most of the wood gases simply by the structure and internal shape of the wood burning firebox.

SUMMARY OF THE INVENTION

The invention provides a wood burning heating system with a furnace enclosed by a water jacket having a given water volume and encasing a firebox in the furnace. A heat exchange surface separates the water in the jacket from the interior of the firebox. A large volume water storage tank is operatively connected to the water jacket so that gravitational flow is established between the water jacket and the water tank. However, pump means may also be operatively interposed between the water jacket and the tank which is directly vented to the atmosphere to maintain the hot water storage tank of large volume at atmospheric pressure at all times. The furnace has a door opening closed by a door so that wood may be charged into the firebox and flue discharge means are connected to the firebox, preferably opposite said door opening. The volume of the hot water storage tank is about 10 to about 20 times larger than the given volume of the water jacket encasing the firebox.

Preferably, the firebox is provided with a refractory bottom and with a refractory lining along the firebox side walls adjacent the firebox bottom.

Advantages of the invention are seen in that due to the size and shape wood pieces of substantial size may be charged into the firebox so that under normal operating conditions refueling will be required only once per day and the gases developed in the firebox will be efficiently burned in the space formed by a vaulted ceiling of the firebox.

Overheating is avoided due to the large size of the tank which is constantly vented to atmospheric pressure. It has been found that the water temperature in the tank will rarely exceed 200° F. An automatic flow type fill valve will maintain the water level in the tank near the top of the tank, however, the tank will not be completely filled to provide for expansion and the arrangement is such, that the water level in the tank is at least one foot higher than the water level in the jacket around the furnace.

BRIEF FIGURE DESCRIPTION

In order that the invention may be clearly understood, it will now be described, by way of example, with reference to the accompanying drawings, wherein:

FIG. 3 is a sectional view along section line 3—3 in FIG. 2;

FIG. 4 is a sectional view through the top portion of the water jacket showing a modified version of the present system;

DETAILED DESCRIPTION OF PREFERRED EXAMPLE EMBODIMENTS AND OF THE BEST MODE OF THE INVENTION

Figure 1:
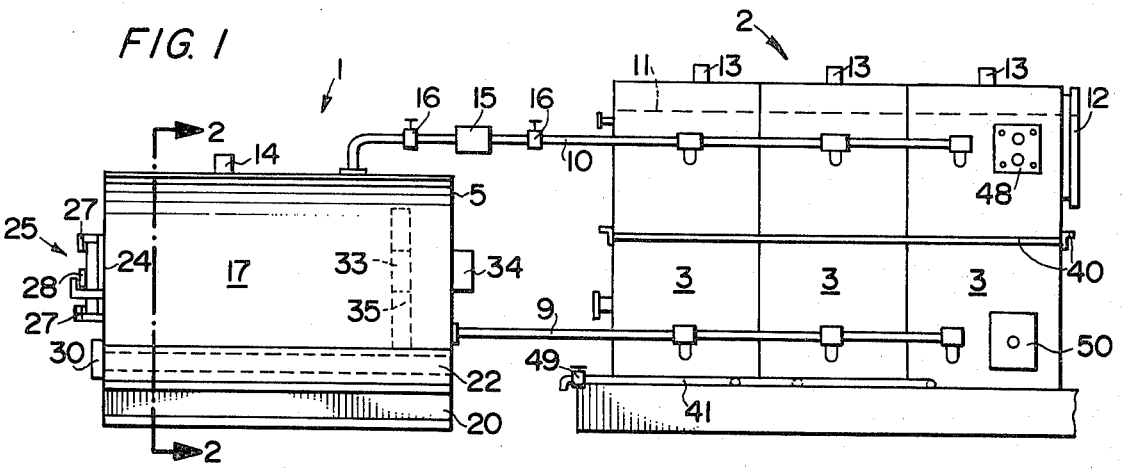
FIG. 1 is a side elevational view of the heating system according to the invention shown in a somewhat schematic manner.
Figure 2:
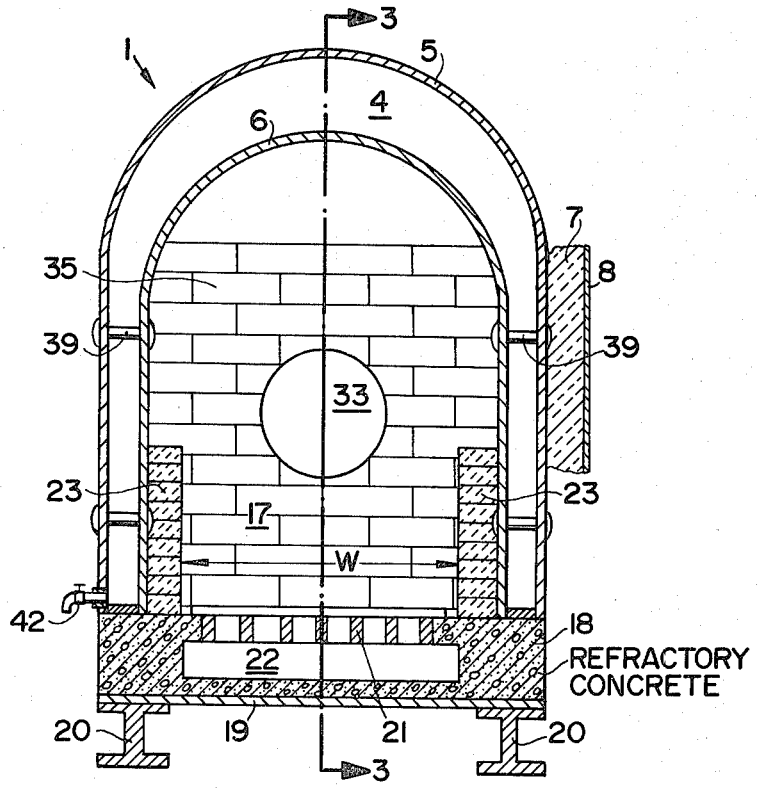
FIG. 2 is a sectional view along section line 2—2 in FIG. 1 showing a section through the furnace on a somewhat enlarged scale relative to FIG. 1.

FIG. 1 shows a side elevational view of a heating system according to the invention including a furnace 1 and a bank 2 of several separate but interconnected hot water tanks 3. The use of several tanks is merely for the convenience of construction. A single large tank could be used if desired. In any event, the total volume of the hot water storage tank means will be substantially larger, preferably 10 to 20 times larger than the volume 4 inside a water jacket having an outer sheet metal wall 5 and an inner sheet metal wall 6 as best seen in FIG. 2. The outer jacket wall 5 is preferably surrounded by heat insulation 7 such as fiberglass which in turn is covered by a sheet metal casing 8 which is only partially shown in FIG. 2 for convenience of illustration.

First pipe means 9 operatively connect the internal volume 4 of the hot water jacket with the interconnected tanks 3. Second pipe means 10 connect the hot water volume 4 to the tank means at an elevational level sufficiently higher than the first pipes 9 to provide for a gravity flow between the volume 4 and the tanks 3. The water level 11 in the tanks 3 will be higher, for example, one foot higher than the top of the water jacket. A visual water level indicator 12 is operatively connected to the tanks 3.

The tanks are vented to the atmosphere by vent openings 13 and the volume 4 of the furnace 1 is also vented through venting means 14. A thermostatic valve 15 may be operatively interposed in the pipe 10. The valve 15 will open, when the temperature in the jacket volume 4 has reached a predetermined value, for example, 200° F. Manually operable shut-off valves 16 may be provided upstream and downstream of the thermostatic valve 15 for maintenance purposes. However, it should be noted that the use of the thermostatic valve 15 is not necessary. It has been found that gravity flow alone was sufficient to heat a 1000 gallon tank from a water jacket volume of approximately 80 gallons from 140° to approximately 200° within about 30 minutes.

The furnace 1 comprises a firebox 17, the bottom of which is made of refractory concrete 18 shown in FIG. 2 or it may be made of refractory bricks. The firebox bottom 18 may be preferably placed on a metal plate 19 which in turn is supported on high beams 20 raising the entire furnace off the floor whereby the heat circulation downwardly is improved and the space in which the furnace is located may be directly heated by the furnace while simultaneously minimizing heat loss through the water jacket by the insulation 7.

The firebox is provided with a conventional, for example, cast iron grating 21 over an ash box 22. The lower portions of the firebox side walls are also lined with firebricks 23 whereby the burning of the wood takes place at higher than normal temperatures. The color of the flame is normally a light yellow and blue. The firebox has a width "W" and a length "X" shown in FIG. 3. The length should correspond to about 1.25 to 2.00 times the given width. Thus, $X=1.25$ to $2\times W$. The grating 21 is arranged adjacent to and immediately below the door opening 24 having an upper edge and a lower edge. The door opening 24 is closed by a door 25 which may be provided with a refractory lining 26 as best seen in FIG. 3. The door 25 is conventionally hinged to the furnace jacket by hinges 27 and may be locked by a latch 28. The grating 21 has a surface area in the order of 0.2 to 0.5 times of the surface area of the firebox bottom. By arranging the grating near the door and by supplying the primary combustion air through the ash box 22 and through a hole 29 in the ash box door 30 it is assured that logs inserted longitudinally and horizontally into the firebox 17 burn also along their entire length in a very efficient manner. Mechanical draft adjustment means 31 for controlling secondary air may also be provided in the door 25. A smoke guard 32 is preferably hinged on the inside to the upper edge of the door opening.

The firebricks 23 extend upwardly from the firebox bottom to a level approximately intermediate the levels defined by the upper and lower edge of the door opening 24.

Flue means 33 and 34 are provided at the end of the longitudinal furnace opposite the door opening. The flue outlet 34 is connected to a chimney not shown. A fire bridge wall 35 also made of firebricks may be provided adjacent the flue outlet end of the furnace as best seen in FIG. 3. Damper means 36, either slidable or hingeable, are provided to close the flue opening 33 to any desired extend, whereby all or part of the combustion gases will flow over the bridge wall 35 as indicated by the arrow 37. This guiding of the combustion gases increases the efficiency of the combustion and has the further advantage that a cleaning trap 38 is established as best seen in FIG. 3. The ash box 22 may extend all the way below the bottom of the firebox to the trap 38 whereby any solid particles accumulated in the right-hand end of the ash box may easily be removed. The use of a bridge wall 35 is beneficial, however, not absolutely critical for the operation of the present heating system.

Such operation is greatly enhanced by the vaulted ceiling 6 which forms the inner wall of the water jacket volume 4. This vaulted shape permits the combustion and wood gases to rise above the firebox toward the vaulted ceiling where they are efficiently combusted.

Incidentally, the furnace jacket walls 5 and 6 may be quarter inch steel plate assembled by welding and spaced by stay bolts 39 best seen in FIG. 2. Similarly, the tank means 3 may be of welded construction. Where several tanks are assembled, they may be held together by tie rods or rails 40 best seen in FIG. 1.

Drain means 41 may be provided for the water tank and drain means 42 may be provided for the furnace.

The means for operating the damper 36 are not illustrated because they are conventional.

Incidentally, the primary air through the opening 29 may be controlled by an automatic thermostat which opens the cross-sectional area of air flow more or less as is conventional and therefore not shown in detail.

The firebox, as described, is large enough to accept a wood load of approximately 3 cubic feet or 100 pounds. Such a load will release approximately 714,000 BTU's. Based on a 60% efficiency this will provide a heat to the water of approximately 428,000 BTU.

In an embodiment comprising four hot water storage tanks each one having a dimension of 30" by 30" by 60" and welded from steel plate having a thickness of 3/16", the capacity of the four tanks was 125 cubic feet or 7,800 pounds of water. The resulting heat capacity was 390,000 BTU based on a tank water temperature of 200° F. at the start and a lower water temperature of 150° F. at the end of the respective time period.

It has been found that a water temperature of approximately 140° F. may be maintained during moderately cold days with a load of 75 to 100 pounds of firewood per day. Loads of approximately 200 pounds per day have been found to be satisfactory on cold days.

The wood pieces could have almost any size up to 14" in diameter and it is not necessary to chop these pieces into four or five sections. Furthermore, it has been found as an added advantage of the present invention that due to the refractory base of the firebox and the side walls 23 of refractory material in the firebox and due to the vaulted shape even green wood has been efficiently burned once the furnace was well started.

A firebox of 26" width (W) and a length (X) of 44" as well as a height of 36" has been found to be quite satisfactory providing a combustion space of about 20 cubic feet so that even if a single charge exceeding the above three cubic feet is used the remaining combustion space is still quite large. For example, a five cubic foot charge corresponding to about 200 pounds of firewood still leaves a space of 15 cubic feet for the gas combustion.

Referring to FIG. 4 a conventional heat exchanger 43, for example, for providing domestic hot water may be inserted into the space 4 between the inner and outer-walls 6 and 5 respectively. For this purpose the spacing between the jacket walls 5 and 6 at the top of the jacket where the heat exchanger 43 is located should be about 2 to 5 times larger than the spacing between the side walls of the water jacket.

The ash box 22 is preferably removable or the ash pit could be cleaned by a conventional scraper tool.

Figure 5:
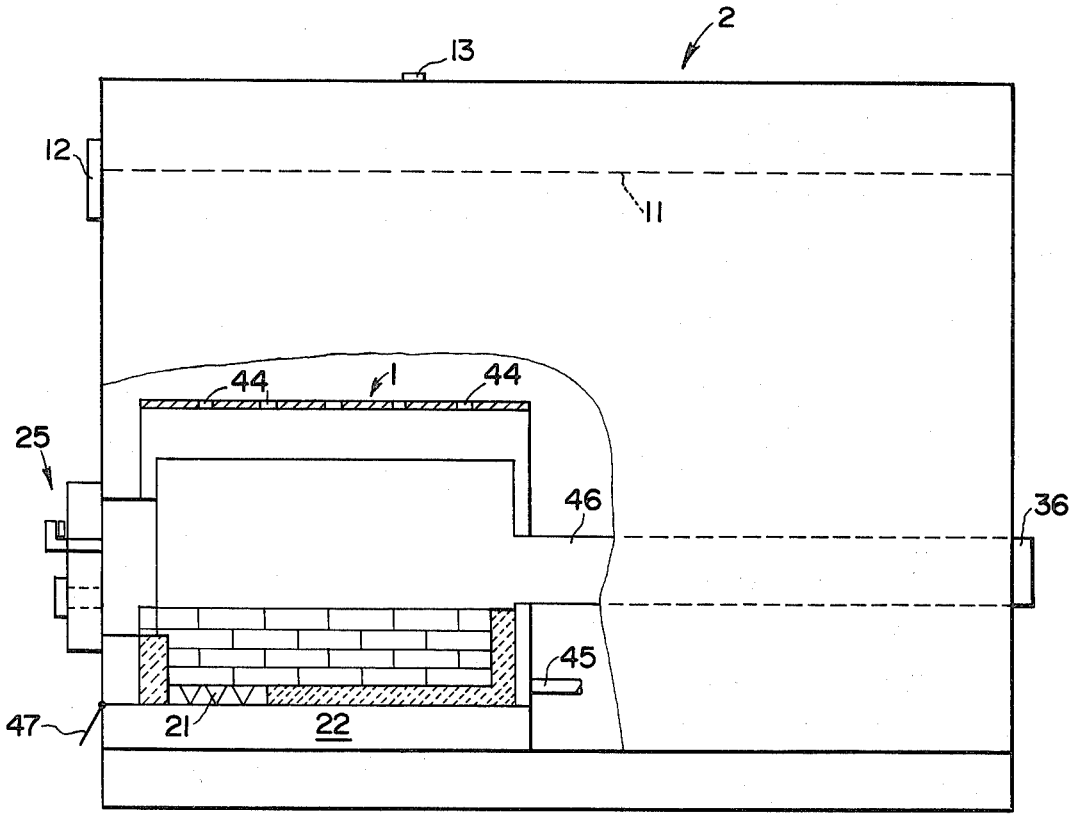
FIG. 5 is a side view, partially in section, through a further modification of a heating system according to the invention.

FIG. 5 shows an embodiment in which the furnace 1 is entirely enclosed in the large volume hot water tank, whereby the water in the tank communicates through openings 44 in the furnace jacket and through an opening 45 at the bottom of the jacket. Otherwise the construction is the same. It should, however, be noted that the flue pipe 46 will extend through the hot water in the tank so that a further utilization of the heat produced is achieved. Otherwise the operation of the embodiment of FIG. 5 is the same as described above. The ash pit door 47 could, for example, be hinged and the opening could be controlled by thermostatic means well known in the art.

A heat exchanger 48 may also, or in the alternative, be installed in any one of the hot water storage tanks 3 for supplying, for example, domestic hot water. Where city water supplies a sufficient pressure through the heat exchanger 43 or 48, the present system is entirely independent of an electrical supply. Even in those instances where an electric pump is used in a private well, hot water may still be drawn into a pail through a faucet 49 as shown in FIG. 1. This complete independence of the present system from the presence of an electrical supply is a marked advantage of the present system as compared to systems which require an electrical supply, for example, for the control of an induced draft fan and/or for the control of a forced draft fan. The invention does not require such draft control fans.

Another advantage of the present system is seen in that auxiliary heating means 50 shown in FIG. 1 may be combined with the present system. Such auxiliary heating means 50 may, for example, comprise an electrical heater driven by a wind operated generator.

With regard to FIG. 1, it is self understood that the vent 14 of the boiler volume 4 must reach to a level above the water level 11 in the tanks 3 to assure the above mentioned gravity flow from the boiler to the tank 3 through the pipe 10 below the water level 11 and from the tank 3 to the boiler through the pipe 9. This may, for example be accomplished by placing the boiler on a base, for example of concrete, of sufficient height or by lengthening the vent pipe 14. Undue experimentations are not involved in establishing the water level 11 above the pipe 10.

Figure 6:
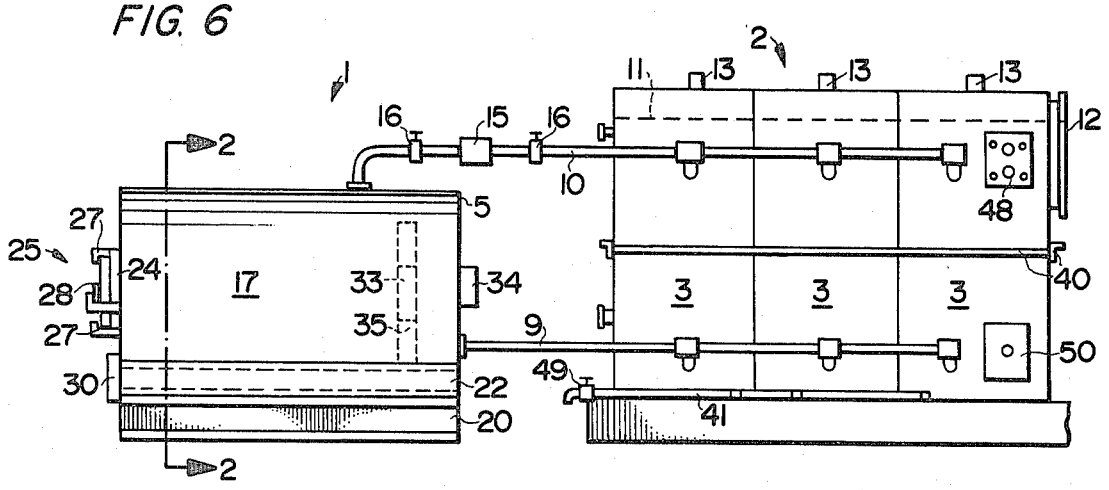
FIGS. 6, 7, 8 and 9 are substantially the same as FIG. 1, but illustrate different ways of venting the present system, whereby FIG. 9 has a lower profile.
Figure 7:
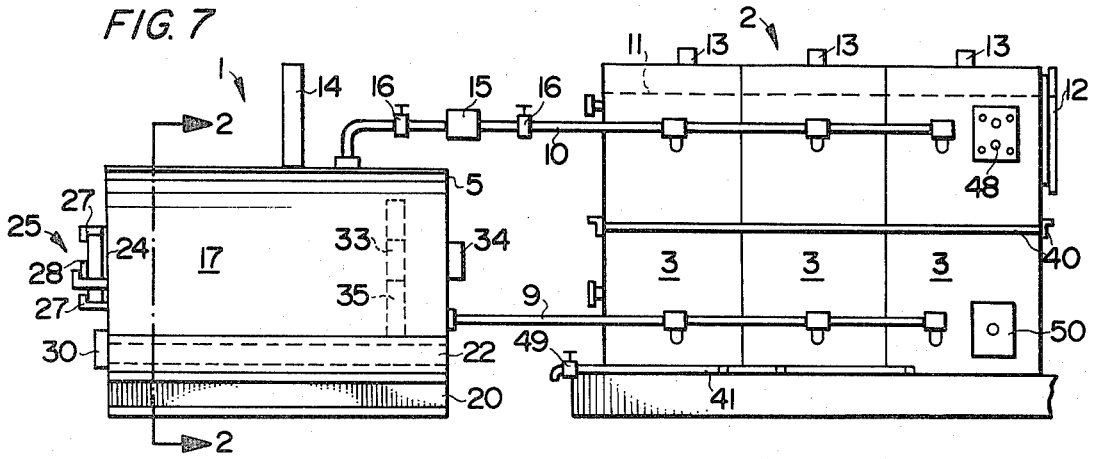
Figure 8:
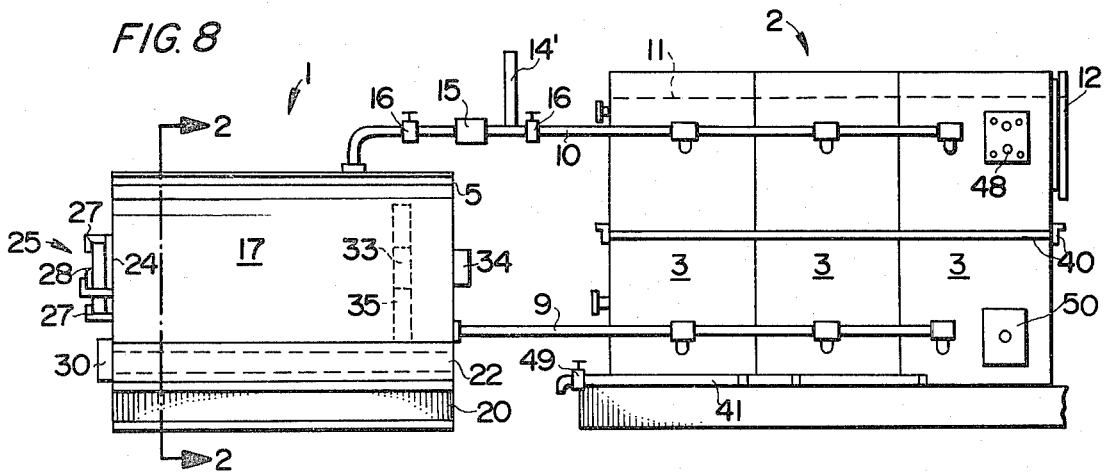

FIG. 6 shows the system of FIG. 1 with only the tanks 3 vented. FIG. 7 shows the system with both the boiler and the tanks vented, if desired. FIG. 8 shows a vent 14' reaching, of course, above the water level 11 of the system of interconnected containers. In all these embodiments including FIG. 1 the system operates at atmospheric pressure, whereby it does not matter where the vent or vents are located as long as the water level 11 is maintained above the return pipe 10. Steam pressure cannot develop in the boiler due to the disclosed venting. The slight difference in water column between the tanks 3 and the boiler 1 that may be present, for example in the embodiment of FIG. 6, is insufficient to permit steam pressure to develop in the boiler. This is an important advantage of the invention because operating the system at atmospheric pressure makes the system safe and simple especially for the heating of private dwellings and the system does not require any safety valves.

Figure 9:
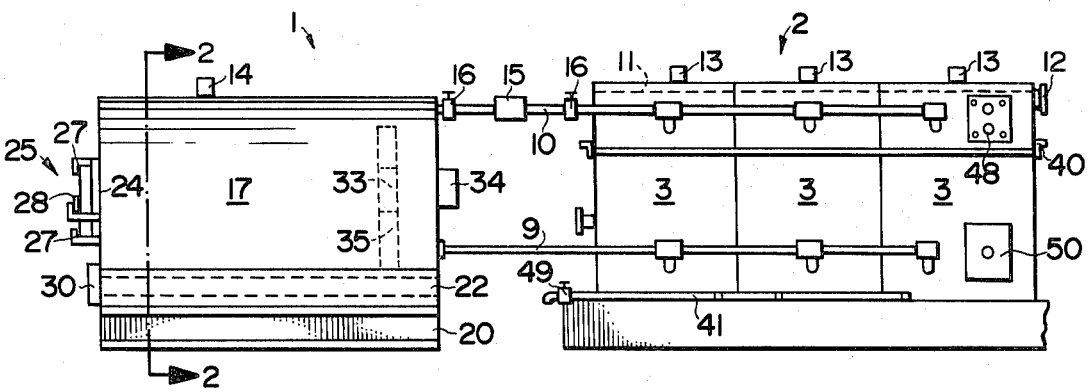

The embodiment of FIG. 9 is basically the same as that of FIG. 1 because it functions in the same way as the embodiment of FIG. 1. However, where the available space for installation has a low ceiling, the system of FIG. 9 is preferred because it has a lower overall height. The venting may be effected in the same manner as described above. In other words the boiler and/or the tank and/or the pipe 10 may be vented above the water level of the connected container system.

Although the invention has been described with reference to specific example embodiments, it will be appreciated, that it is intended to cover all modifications and equivalents within the scope of the appended claims.

What is claimed is:

1. A solid fuel burning heating system, comprising furnace means including a firebox, water jacket means having a given water volume encasing said firebox and including an inner jacket wall forming a heat exchange surface for separating water in said water jacket means from the interior of said firebox means, separate hot water storage tank means having a volume which is substantially larger than said given water volume in said water jacket means, first pipe means (9) connecting said water jacket means (4) to said hot water storage tank means (3) at a first relatively low elevational level, second pipe means (10) connecting said water jacket means to said hot water storage tank means at a second elevational level sufficiently higher than said first low elevational level yet below the water level in said hot water storage tank means for assuring a gravity water circulation flow between said water jacket means and said hot water storage tank means, said water jacket means, said hot water storage tank means and said first and second pipe means forming an interconnected container system having a common water level (11), door means including a door opening operatively connected to said firebox means for charging fuel into said firebox means, flue discharge means operatively connecting said firebox means to a chimney, and vent means operatively connecting the entire interconnected container system at all times during its operation to the atmosphere at a third elevational level located above said common water level (11) in said interconnected container system to assure said gravity water circulation flow.

2. The system of claim 1, wherein said firebox means comprise a refractory bottom, grating means in said refractory bottom, and refractory lining means covering the internal side walls of said firebox means to a level approximately between the levels defined by the upper and lower edge of said door opening.

3. The system of claim 2, wherein said refractory bottom of said firebox means has a substantially rectangular shape with a given width and with a length corresponding to about 1.25 to 2.00 times said given width, said grating means being arranged in said refractory firebox bottom adjacent said door means and having a surface area corresponding to about 0.2 to 0.5 times the surface area of the entire firebox bottom, said furnace means further comprising ash pit means below said grating means, and mechanical draft adjustment means operatively arranged for admitting combustion air through said grating means into said firebox means, said door means being arranged at a narrow end of said firebox means opposite said flue discharge means for a front and lengthwise loading of firewood into said firebox means.

4. The system of claim 3, wherein said firebox means further comprise refractory bridge wall means spaced from said flue discharge means to form a flue channel and a cleaning trap between said refractory wall means and said water jacket means, said ash pit means having a length reaching all the way to said cleaning trap.

5. The system of claim 3, further comprising a removable ash box in said ash pit.

6. The system of claim 1, further comprising smoke guard means inwardly hinged across said door opening, and damper means operatively arranged in said flue discharge means.

7. The system of claim 1, further comprising leg means supporting said furnace means above the floor whereby heat radiating downwardly from said firebox means is also utilized for space heating.

8. The system of claim 1, wherein said water jacket means comprise an inner housing welded of plate metal and including an arched ceiling, and an outer housing welded of plate metal to form a substantially rectangular box also having an arched ceiling, said inner housing being smaller than said outer housing to such an extent that a given uniform spacing is provided between the two housings on all sides where the housing walls face each other expect at said arched ceilings where a spacing is provided corresponding to a multiple of said given spacing, said multiple being in the range of about two to five.

9. The system of claim 8, further comprising hot water heat exchanger means operatively located in said furnace means in the space intermediate said arched ceilings.

10. The system of claim 1, wherein said volume of said hot water storage tank means is within the range of about ten to twenty times said given water volume of said water jacket means.

11. The system of claim 1, wherein said firebox means has a volume of about 10 to 30 cubic feet for receiving at least firewood charges of random size up to about 200 pounds, whereby a substantial space in said firebox volume is provided for burning wood combustion gases.

12. The system of claim 1, further comprising fire resistant insulating means substantially enclosing said furnace means and said hot water storage tank means, and sheet metal casing means substantially enclosing said insulating means.

13. The system of claim 1, wherein said furnace means are installed inside said hot water storage tank means.

14. The system of claim 1, further comprising heat exchanger means operatively installed in said hot water storage tank means.

15. The system of claim 1, wherein said vent means are connected to said second pipe means.

16. The system of claim 1, wherein said vent means are connected to said hot water storage tank means.

17. The system of claim 1, wherein said hot water storage tank means (2) comprise a plurality of separate tanks (3) operatively interconnected, said second hole means (13) comprising at least one hole above the water level in each tank (3) for directly venting each tank (3) to the atmosphere.

18. The system of claim 1, wherein said vent means are connected to said water jacket means.

19. The system of claim 1, further comprising auxiliary heating means operatively installed in said hot water storage tank means.

20. A solid fuel burning heat system, comprising furnace means including a firebox, water jacket means having a given water volume encasing said firebox and including an inner jacket wall forming a heat exchange surface for separating water in said water jacket means from the interior of said firebox means, first venting means in said water jacket means (4, 5, 6) for directly venting said water jacket means to the atmosphere at all times during its operation, separate hot water storage tank means having a volume substantially larger than said given volume in said water jacket means, second venting means above the water level in said hot water storage tank means (3) for also directly venting said hot water storage tank means to the atmosphere to maintain said hot water storage tank means at atmospheric pressure at all times, first pipe means connecting said water jacket means to said hot water storage tank means at a first relatively low elevational level, second pipe means connecting said water jacket means to said hot water storage tank means at a second elevational level sufficiently higher than said first low elevational level yet below the water level in said hot water storage tank means for assuring a gravity water flow between said water jacket means and said hot water storage tank means, said first and second pipe means forming with said water jacket means and with said hot water storage tank means an interconnected container system having a common water level, said interconnected container system being vented to the atmosphere by said first and second venting means during its operation, door means including a door opening operatively connected to said firebox means for charging fuel into said firebox means, and flue discharge means operatively connecting said firebox means to a chimney, and wherein said separate hot water storage tank means comprise a plurality of tanks (3) and means operatively interconnecting said plurality of tanks (3) to form said larger tank volume, said substantially larger volume of said tank means thereby providing a heat buffer volume.

* * * * *